US006394742B1

(12) United States Patent
Buscema

(10) Patent No.: US 6,394,742 B1
(45) Date of Patent: May 28, 2002

(54) METHOD FOR STACKING BOXES AND REMOVAL OF INDIVIDUAL BOXES FROM THE STACK

(75) Inventor: Craig W. Buscema, Atlanta, GA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/560,218

(22) Filed: Apr. 28, 2000

Related U.S. Application Data

(60) Provisional application No. 60/132,094, filed on Apr. 30, 1999.

(51) Int. Cl.[7] ..... B65B 17/00

(52) U.S. Cl. ..... 414/801; 414/802; 229/191; 229/143; 229/918; 229/DIG. 11

(58) Field of Search ..... 414/801, 802; 229/DIG. 11, 191, 918, 143

(56) References Cited

U.S. PATENT DOCUMENTS 3,568,877 A * 3/1971 Mastrica ..... 220/65
4,123,869 A * 11/1978 Witt ..... 43/1
4,126,265 A * 11/1978 Holmes ..... 229/32
4,192,562 A * 3/1980 Bishoff et al. ..... 312/108
4,498,584 A * 2/1985 Newbury ..... 206/510
4,600,142 A * 7/1986 Quaintance ..... 229/143
4,854,461 A * 8/1989 Daniel et al. ..... 222/4 R
5,294,044 A * 3/1994 Clark ..... 229/191
5,452,848 A * 9/1995 Mur Gimeno ..... 229/191
5,499,764 A * 3/1996 Carlsson ..... 229/117.16

* cited by examiner

*Primary Examiner*—Joseph A. Fischetti
(74) *Attorney, Agent, or Firm*—Michael V. Drew

(57) ABSTRACT

Boxes each having opposing top and bottom walls adjoining opposing end walls and opposing side walls spaced apart a width adjoining the opposing top and bottom walls and the opposing end walls and having recessed end structure wherein a portion of the opposing side walls adjacent at least one of the opposing end walls that is narrower widthwise than the width are disposed diagonally inwardly and at least one of the top and bottom walls is tapered inwardly to the at least one of the opposing end walls that is narrower widthwise than the width, and arranging the boxes in an array of at least one row wherein each row contains the boxes disposed abreast one another with respective opposing end walls adjacent one another such that an opening is formed between adjacent opposing end walls.

4 Claims, 4 Drawing Sheets

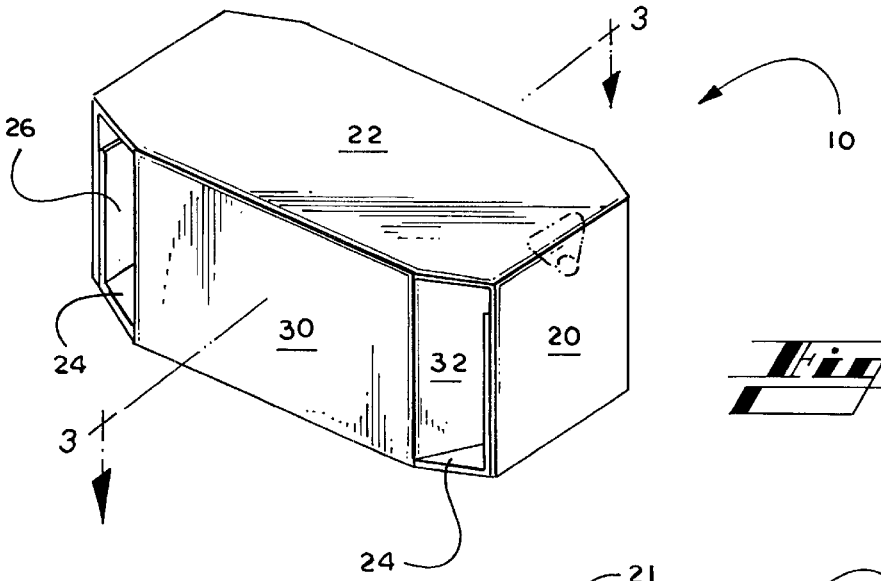
Fig_1
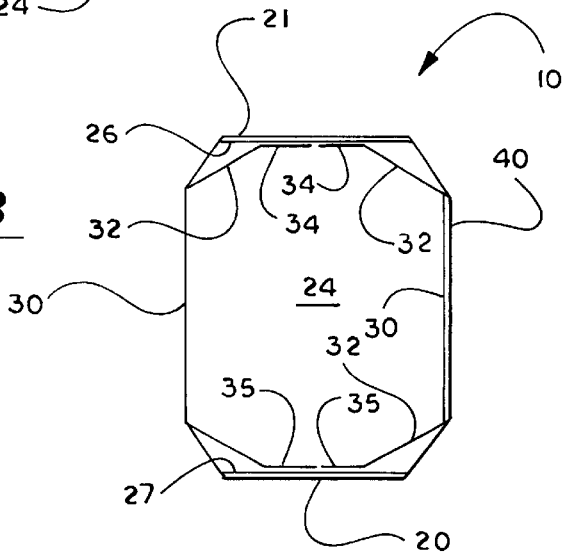
Fig_3
Fig_4
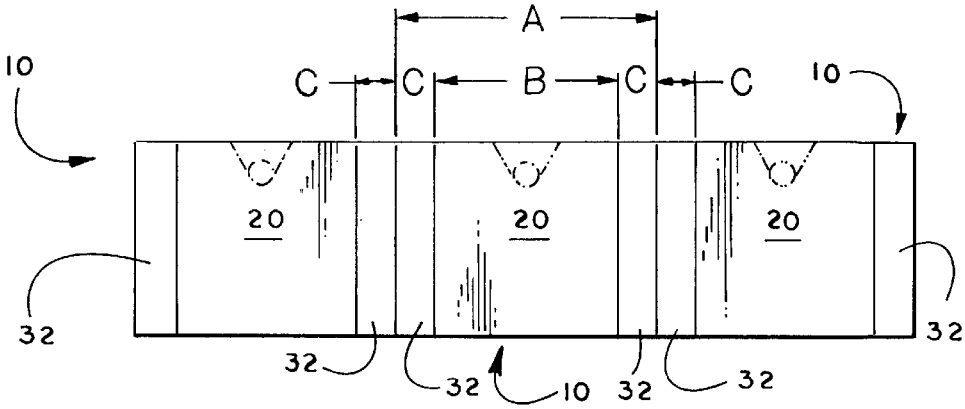

METHOD FOR STACKING BOXES AND REMOVAL OF INDIVIDUAL BOXES FROM THE STACK

This application claims the benefit of priority under provisional application number 60/132,094, filed Apr. 30, 1999.

The invention relates to boxes, and, more particularly, relates to a method for stacking boxes so as to facilitate removal of individual boxes from the stack.

Boxes are useful for storing, transporting and dispensing a variety of subject matter. For example, containers of foodstuffs such as plastic bags of soft-drink syrup.

Boxes are often stacked upon one another for shipping or storage. Often, it is difficult to remove an individual box from a stack of boxes because the boxes are so closely positioned with respect to one another that an individual box cannot be easily grasped. Thus, it would be useful to have a means for stacking boxes that facilitates removal of an individual box from a closely-packed stack.

SUMMARY OF THE INVENTION

The present invention provides a box having a recessed end structure wherein a portion of the side walls directly adjacent the end walls are diagonally disposed inwardly and at least one of the top and bottom walls is tapered inwardly to an end wall that is widthwise more narrow than the width of the box. Side edges of the end wall of the box are inwardly offset with respect to the side walls of the box. The boxes are stacked in side-by-side contiguous arrangement with end walls linearly adjacent one another whereby the offsets of adjacent boxes present an opening through which the end wall of a box may be conveniently grasped.

Other advantages and objects of the present invention will be apparent from the following description, the accompanying drawings, and the appended claims.

BRIEF DESCRIPTION OF THE DRAWINGS

FIG. 1 is an isometric illustration of a box suitable for use in a method for stacking boxes and removal of individual removal of boxes from the stack, in accordance with a preferred embodiment of the invention.

FIG. 3 is a view of the box of FIG. 1 taken along line X—X of FIG. 1.

FIG. 4 is an elevational illustration of a row of boxes of FIG. I arranged in a side-by-side contiguous configuration.

DETAILED DESCRIPTION OF THE PREFERRED EMBODIMENT

Figure 2:
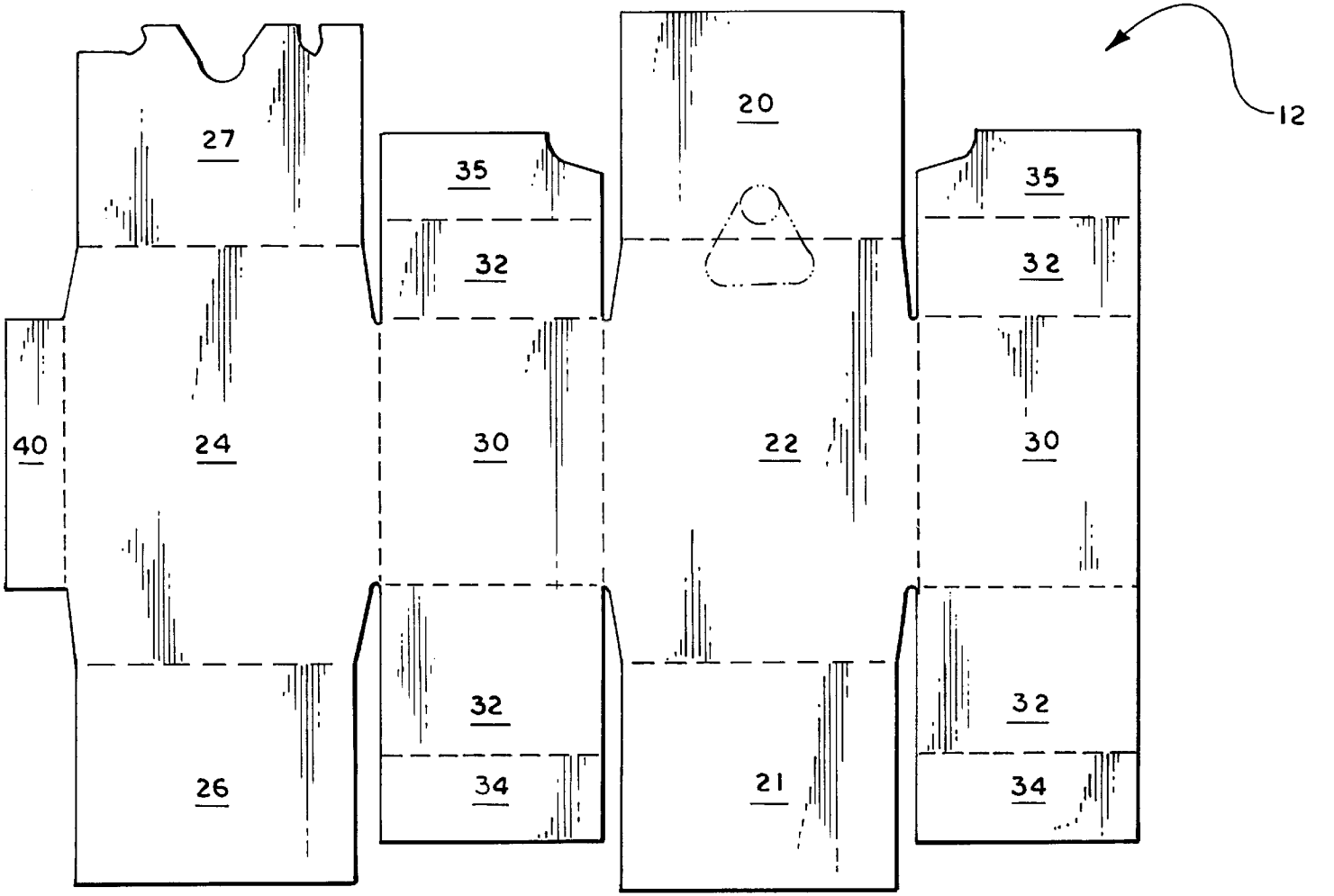
FIG. 2 is a plan view of the underside of a blank for forming the box of FIG. 1.

Throughout the drawings, the same reference numerals are used to denote the same or like features of the invention.

Referring first to FIG. 1, therein is illustrated a box 10 suitable for use in a method for stacking boxes in accordance with a preferred embodiment of the invention. FIG. 2 illustrates the inner surface of a blank 12 for forming the box of FIG. 1. Reference may be made simultaneously to FIGS. 1, 2 and 3 for ease of understanding the following description.

The end structures of the erected box 10 have recessed areas at the region of intersection of the end walls and the pair of opposing side walls 30,40. In the preferred embodiment illustrated, the end walls are composite walls, each formed from a pair of overlapping flaps denoted by numerals 20 and 27 at one end and denoted by numerals 21 and 26 at the opposing end of the box 10. The box 10 has eight parallel vertical walls, including orthogonally-oriented end 20/27, 21/26 and side 30 walls, and diagonally-oriented panels 32. Recesses at the ends of the box 10 are formed by the diagonally-oriented panels 32 lying inwardly of the side edges of the end walls 20/27, 21/26 and inwardly of the beveled edges of the top 22 and bottom 24 walls. The diagonal flaps 32 are joined by end flaps 34 to the inner ply end walls 26, 27. Adherence of the joinder flap 40 to the side wall 30 completes tubular formation of the box.

Referring now particularly to FIGS. 3 and 4, the composite end walls 20/27, 21/26 are width-wise B narrower than the width A of the box 10. The edges of the top 22 and bottom 24 walls taper inwardly (as shown more clearly in FIGS. 1, 2 and 3) as a transition from the width A to width B. The offset C between the width B of the end wall 20 and the overall width A of the box 10 has been exaggerated slightly for clarity.

Figure 5:
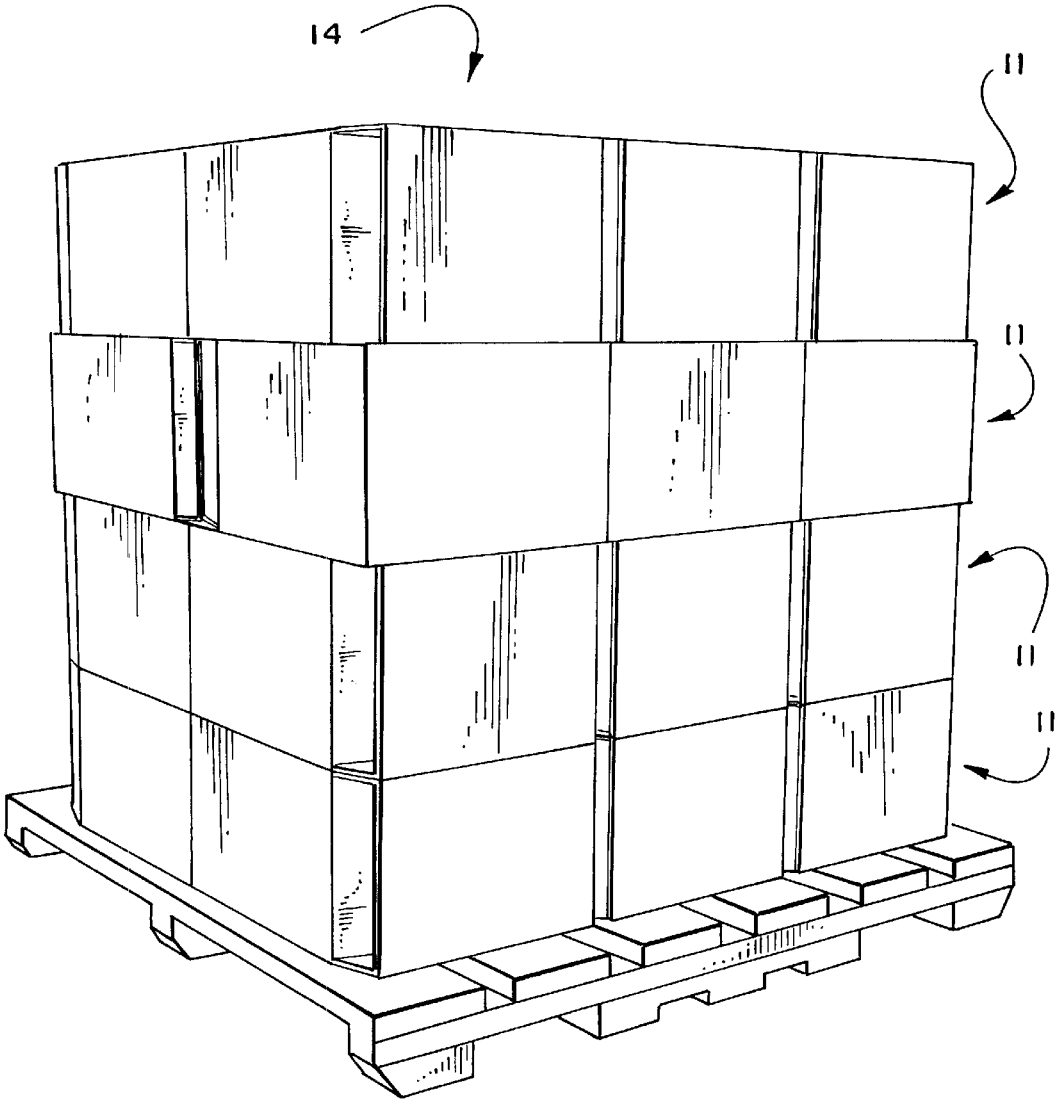
FIG. 5 is an isometric illustration of boxes having the features of the box of FIG. 1, stacked in a matrix configuration, in accordance with a preferred embodiment of the invention.
Figure 6:
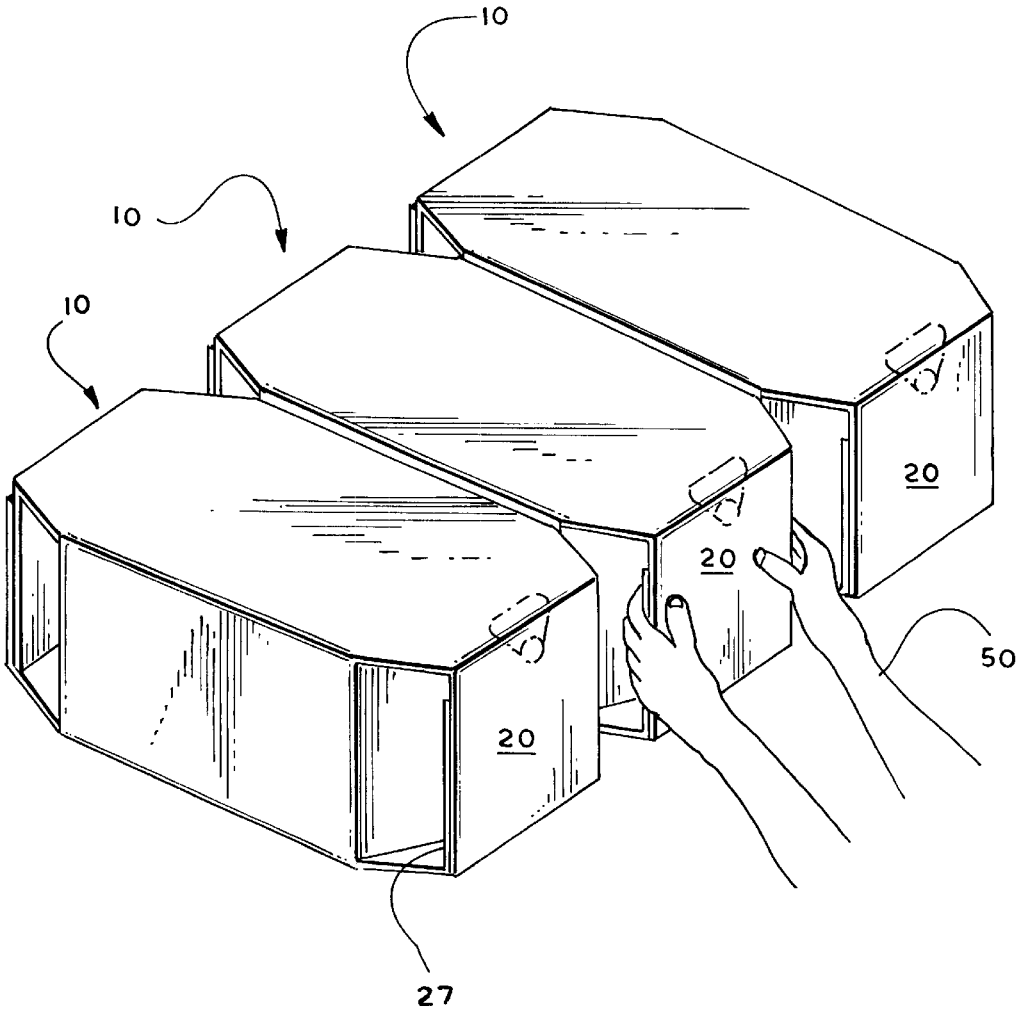
FIG. 6 is an illustration of the manner in which an individual box may be removed from the row of boxes of FIG. 4 or a row contained in the matrix of FIG. 5, in accordance with a preferred embodiment of the invention.

When the boxes 10 are arranged contiguously side-by-side, as depicted in FIG. 4, a voided region have a width of 2C is formed between each adjoining pair of boxes 10. When the boxes 10 are stacked in a matrix 14 as shown in FIG. 5, the voided region 2C and the flange presented by the composite end walls 20/27, 21/26 provide a means for grasping and manipulating an individual box 10, as depicted in FIG. 6. The recessed space provided by the diagonal flaps 32 and the opening having a width 2C permits access for hands 50 of an individual or a box-manipulating or box-grasping tool.

The perforated "punch-out" tab that is depicted at the intersection of the end wall 20 and the top wall 22 of the box 10 is useful for positioning the spout of an enclosed article, such as a plastic bag containing soft-drink syrup. This feature has been depicted to illustrate the environment in which the invention may be practiced.

Modifications may be made in the foregoing without departing from the scope and spirit of the claimed invention. For example, while both ends of the boxes depicted in FIGS. 1–4 and FIG. 6 have recessed regions at both ends of the box, the invention may also be practiced with boxes 11 such as those depicted in the matrix 14 of FIG. 6 wherein only one end has recessed regions. It is also to be noted that the diagonal recessed flaps 32 of the box provide a reinforcing structure that is beneficial when the boxes are stacked. As a further example of a modification that does not depart from the scope or spirit of the invention, the invention may be practiced with only one of the top and bottom edges of the walls 20/27, 21/26 being widthwise more narrow than the width of the box 10.

What is claimed is:

1. A method for stacking boxes comprising the steps of:

providing a plurality of boxes each box having opposing top and bottom walls adjoining opposing end walls and opposing side walls, said opposing end walls being widthwise narrower than a width of said top and bottom walls, said opposing side walls being spaced apart the width of said opposing top and bottom walls, having recessed end structure wherein a portion of said opposing side walls adjacent at least one of said opposing end walls is disposed diagonally inwardly of side edges of said end wall and at least one of the top and bottom walls is tapered inwardly to said at least one of said opposing end walls, and arranging said plurality of boxes in an array of at least one row wherein each said row contains said boxes disposed abreast one another with respective said at least one of said opposing end walls that is narrower widthwise than said width adjacent one another such that an opening is formed between adjacent respective said opposing end walls.

2. The invention of claim 1, wherein said at least one of said opposing end walls that is narrower widthwise than said width of an individual box comprises both of said opposing end walls.

3. An arrangement of boxes disposed in an array formed by the method of providing a plurality of boxes each box having opposing top and bottom walls adjoining opposing end walls and opposing side walls, said opposing end walls being widthwise narrower than a width of said top and bottom walls, said opposing side walls being spaced apart the width of said opposing top and bottom walls, having recessed end structure wherein a portion of said opposing side walls adjacent at least one of said opposing end walls is disposed diagonally inwardly and at least one of the top and bottom walls is tapered inwardly to said at least one of said opposing end walls whereby a recessed region is formed at at least one comer of said box by said end wall, said side wall and at least one of said top and bottom walls, and arranging said plurality of boxes in an array of at least one row wherein each said row contains said boxes disposed abreast one another with respective said at least one of said opposing end walls that is narrower widthwise than said width adjacent one another such that an opening is formed between adjacent respective said opposing end walls.

4. The invention of claim 3, wherein said at least one of said opposing end walls that is narrower widthwise than said width of an individual box comprises both of said opposing end walls.

* * * * *